US009212035B1

(12) United States Patent
Smith

(10) Patent No.: US 9,212,035 B1
(45) Date of Patent: Dec. 15, 2015

(54) AIR-COMPRESSING AUTOMOTIVE JACK APPARATUS

(71) Applicant: Robert O. Smith, Antioch, TN (US)

(72) Inventor: Robert O. Smith, Antioch, TN (US)

( * ) Notice: Subject to any disclaimer, the term of this patent is extended or adjusted under 35 U.S.C. 154(b) by 276 days.

(21) Appl. No.: 13/852,419

(22) Filed: Mar. 28, 2013

(51) Int. Cl.
*B66F 3/24* (2006.01)
*B66F 3/35* (2006.01)
*B66F 5/00* (2006.01)

(52) U.S. Cl.
CPC . *B66F 3/247* (2013.01); *B66F 3/35* (2013.01); *B66F 5/00* (2013.01)

(58) Field of Classification Search
CPC ..... B66F 3/40; B66F 3/35; B66F 3/247; B66F 5/00
USPC ... 254/93 R, 93 VA, 93 L, 93 A, 93 HP, 93 H
See application file for complete search history.

(56) References Cited

U.S. PATENT DOCUMENTS

| | | | | |
|---|---|---|---|---|
| 2,070,960 | A * | 2/1937 | Phillips | 254/93 HP |
| 3,185,238 | A * | 5/1965 | Coates | 180/125 |
| 4,314,592 | A * | 2/1982 | Silvey | 144/34.2 |
| 4,678,164 | A | 7/1987 | Yang | |
| 4,706,937 | A | 11/1987 | Chung | |
| 4,872,230 | A | 10/1989 | Levine | |
| 5,085,407 | A | 2/1992 | Lonon | |
| 5,669,086 | A * | 9/1997 | Garman | 5/86.1 |
| 6,929,249 | B1 * | 8/2005 | Kim | 254/93 HP |
| D537,604 | S | 2/2007 | Redman | |
| 2009/0230783 | A1 * | 9/2009 | Weed et al. | 307/150 |
| 2012/0248393 | A1 * | 10/2012 | Moore et al. | 254/93 HP |
| 2013/0187107 | A1 * | 7/2013 | Coccaro | 254/93 R |

FOREIGN PATENT DOCUMENTS

| | | | |
|---|---|---|---|
| CN | 201560090 | U * | 8/2010 |
| CN | 202116237 | U * | 4/2011 |
| DE | 1781009 | A1 * | 10/1970 |
| FR | 2265666 | A * | 11/1975 |
| FR | 2350891 | A1 * | 12/1977 |
| JP | 02261798 | A * | 10/1990 |

* cited by examiner

*Primary Examiner* — Lee D Wilson
*Assistant Examiner* — Joel Crandall

(57) ABSTRACT

An air-compressing automotive jack apparatus simplifies the task of lifting and lowering a vehicle for repairs and maintenance by using an air compressor powered by the vehicle's battery. The apparatus includes a housing configured for positioning under a frame of a vehicle. An air compressor and a bag are coupled to the housing. The bag is operationally coupled to the air compressor wherein the air compressor is configured to supply air to the bag such that the bag is inflated when air is received. A handle extends outwardly from the housing and is operationally coupled to the air compressor wherein the air compressor is configured to deflate the bag when the handle is in a lowered position and inflate the bag when the handle is in a raised position. A pair of cables is coupled to the air compressor and configured for coupling to a power supply in the vehicle.

16 Claims, 3 Drawing Sheets

AIR-COMPRESSING AUTOMOTIVE JACK APPARATUS

BACKGROUND OF THE DISCLOSURE

Field of the Disclosure

The disclosure relates to automotive jacks and more particularly pertains to a new automotive jack for simplifying the task of lifting and lowering a vehicle for repairs and maintenance by using an air compressor powered by the vehicle's battery.

SUMMARY OF THE DISCLOSURE

An embodiment of the disclosure meets the needs presented above by generally comprising a housing configured for positioning under a frame of a vehicle. An air compressor and a bag are coupled to the housing. The bag is operationally coupled to the air compressor wherein the air compressor is configured to supply air to the bag such that the bag is inflated when air is received. A handle extends outwardly from the housing and is operationally coupled to the air compressor wherein the air compressor is configured to deflate the bag when the handle is in a lowered position and inflate the bag when the handle is in a raised position. A pair of cables is coupled to the air compressor and configured for coupling to a power supply in the vehicle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
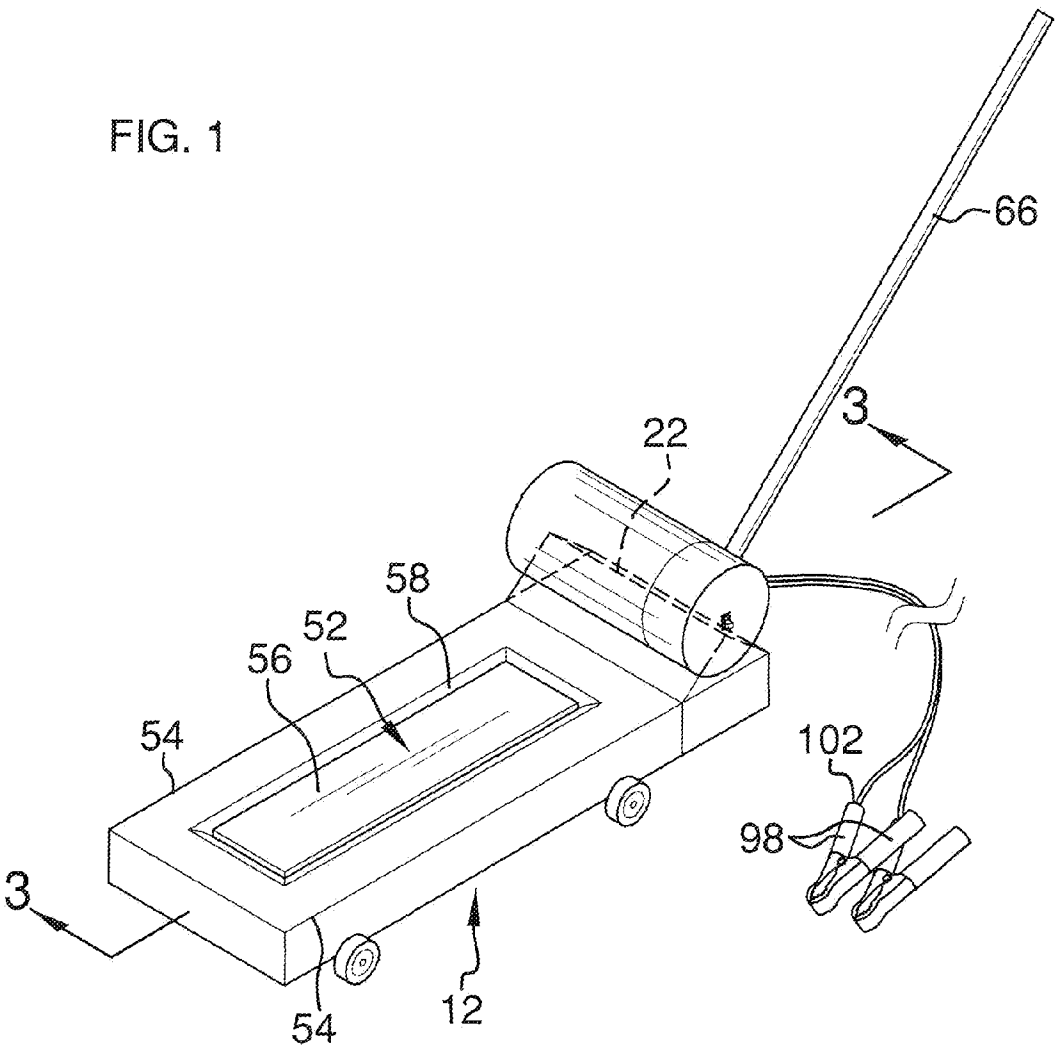
FIG. 1 is a top front side perspective view of an air-compressing automotive jack apparatus having a deflated air bag according to an embodiment of the disclosure.
Figure 2:
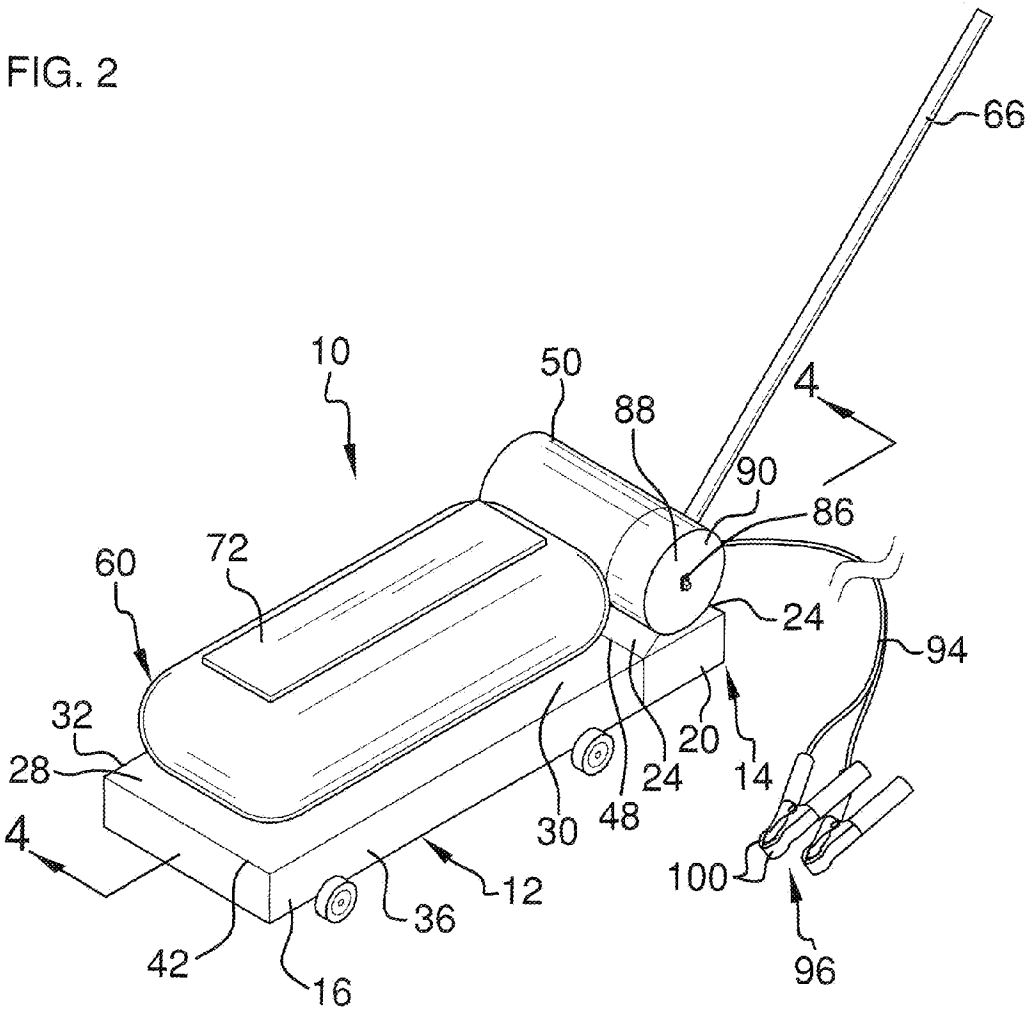
FIG. 2 is a top front side perspective view of an embodiment of the disclosure similar to FIG. 1, except that the air bag is inflated in FIG. 2.
Figure 3:
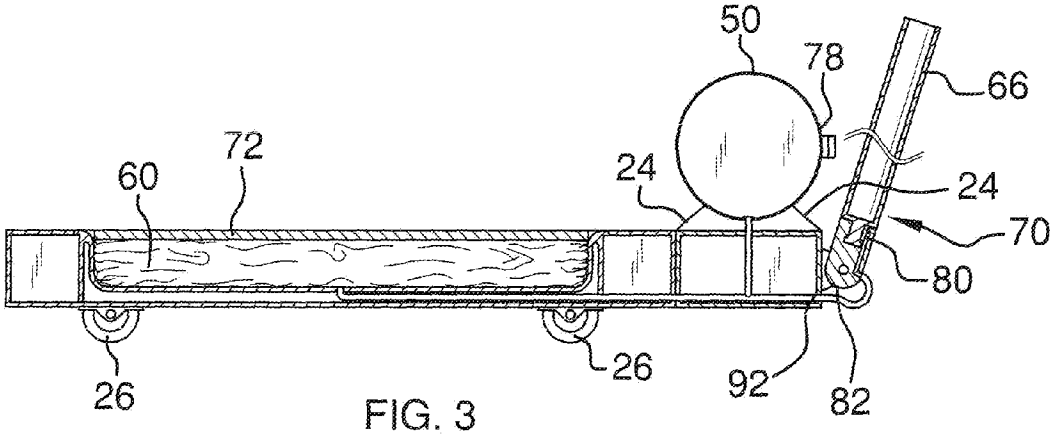
FIG. 3 is a cross-sectional view of an embodiment of the disclosure taken along line 3-3 of FIG. 1.
Figure 4:
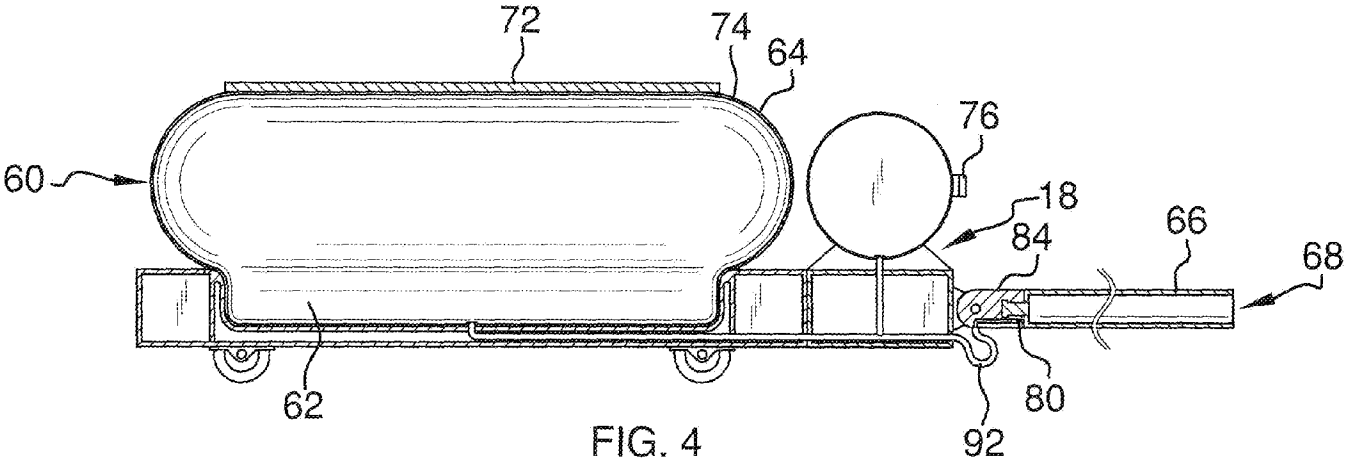
FIG. 4 is a cross-sectional view of an embodiment of the disclosure taken along line 4-4 of FIG. 2.

With reference now to the drawings, and in particular to FIGS. 1 through 4 thereof, a new automotive jack embodying the principles and concepts of an embodiment of the disclosure and generally designated by the reference numeral 10 will be described.

As best illustrated in FIGS. 1 through 4, the air-compressing automotive jack apparatus 10 generally comprises a housing 12 configured for positioning under a frame of a vehicle. The housing 12 comprises a front end 14 and a back end 16. The front end 14 has an upper portion 18 and a lower portion 20. The upper portion 18 comprises a crest 22 and a pair of slanted surfaces 24 extending outwardly and downwardly from the crest 22. The housing 12 is preferably lightweight to allow for easy portability. The housing 12 is preferably made from recyclable, heavy-duty material, including plastic, lightweight metal, or the like.

A plurality of spaced wheels 26 is coupled to the housing 12. One pair of wheels 26 is coupled to a first side 32 of the back end 16. One pair of wheels 26 is coupled to a second side 36 of the back end 16. One pair of wheels 26 is coupled to a back portion 28 of the back end 16 proximate a first lateral edge 42. One pair of wheels 26 is coupled to a front portion 30 of the back end 16 proximate a second lateral edge 48.

An air compressor 50 is coupled to the housing 12 and may be positioned on the front end 14 above each of the slanted surfaces 24. The air compressor 50 is preferably lightweight. The air compressor 50 may be cylindrical. The air compressor 50 may be 120 V and between 1.5 and 2 horsepower. The air compressor 50 is configured to hold between approximately 2 and 10 liters of air. The air compressor 50 is preferably oil-free. A cavity 52 extends downwardly into the housing 12 and longitudinally across the back end 16 of the housing 12. The cavity 52 is preferably offset from a pair of opposed long edges 54 of the back end 16 and the first and second lateral edges 42, 48 of the back end 16. The cavity 52 has a bottom surface 56 and a perimeter edge 58 extending upwardly away from the bottom surface 56. The perimeter edge 58 may be angled outwardly relative to the bottom surface 56. The cavity 52 is preferably made from metal. A bag 60 is coupled to the housing 12 and is operationally coupled to the air compressor 50 wherein the air compressor 50 is configured to supply air to the bag 60 such that the bag 60 is inflated when the air is received. The bag 60 is preferably constructed from heavy-duty vinyl, rubber, or the like. The bag 60 comprises a lower section 62 and an upper section 64 wherein the lower section 62 lines the cavity 52 in the housing 12 and the upper section 64 extends outwardly from the housing 12. The upper section 64 is directed upwardly away from the housing 12 when the bag 60 is filled with air wherein the bag is configured to lift the vehicle when air is received therein and lower the vehicle when air is released therefrom. The air compressor 50 may automatically turn off when the bag 60 reaches a predetermined height. The predetermined height may vary depending on the type of vehicle for which use is desired and may fall anywhere between 30 centimeters and 80 centimeters. A light may be positioned on the air compressor 50 and be operationally coupled to a battery of the vehicle wherein the light is configured to transmit light energy when power is supplied by the battery.

An elongated handle 66 extends outwardly from the housing 12. The handle 66 is operationally coupled to the air compressor 50 wherein the air compressor 50 is configured to deflate the bag 60 when the handle 66 is in a lowered position 68 and inflate the bag 60 when the handle 66 is in a raised position 70. A shield 72 is coupled to the bag 60 and positioned on a top side 74 of the bag 60 wherein the shield 72 is configured to abut a surface under the vehicle and protect the bag 60 from damage. The shield 72 is preferably metal so as to protect the bag 60 from sharp objects.

An intake valve 76 is coupled to the air compressor 50 wherein the intake valve 76 is configured to receive air from the air compressor 50 when the intake valve 76 is opened. The intake valve 76 may be positioned on a back side 78 of the air compressor 50. A release valve 80 is coupled to the handle 66 proximate a bottom end 82 of the handle 66. The release valve 80 may be positioned in an interior space 84 of the handle 66. The release valve 80 is operationally coupled to the handle 66 wherein the release valve 80 is opened when the handle 66 is manipulated into the lowered position 68 and the release valve 80 is closed when the handle 66 is manipulated into the raised position 70. An on/off switch 86 is coupled to the air compressor 50. The switch 86 is positioned on an exterior face 88 of a first end 90 of the air compressor 50. The switch 86 is electrically coupled to the intake valve 76 wherein the intake valve 76 is opened and configured to receive air when the switch 86 is in an on position and the intake valve 76 is closed when the switch 86 is in an off position. A hose 92 couples the air compressor 50, the bag 60, and the handle 66.

A pair of cables 94 is removably coupled to the air compressor 50 wherein the cables 94 are configured for coupling to a power supply of the vehicle. The power supply may comprise the battery of the vehicle wherein the cables 94 comprise a negative cable couplable to a negative battery post of the vehicle and a positive cable couplable to a positive battery post of the vehicle. Each of the cables 94 has a length between approximately 550 centimeters and 800 centimeters. The cables 94 are detachable from the air compressor 50 when not in use. A pair of clips 96 is provided. The clips 96 are preferably alligator clips that connect to the vehicle's battery. Each of the clips 96 has a pair of grips 98 and a pair of jaws 100 wherein the grips 98 are configured to open the jaws 100 when the grips 98 are urged together. The jaws 100 are preferably serrated. One of the grips 98 of each of the clips 96 may be coupled to a second end 102 of an associated one of the cables 94.

The apparatus 10 has a length between approximately 35 centimeters and 60 centimeters; a width between approximately 10 centimeters and 40 centimeters; and a height between approximately 2 centimeters and 15 centimeters. It is understood that the size of the apparatus 10 may be larger or smaller depending on a size of the particular vehicle. The apparatus 10 may preferably withstand weight loads between 1300 kilograms and 4150 kilograms.

In use, as stated above and shown in the Figures, the apparatus 10 is positioned under the frame of the vehicle and the vehicle's hood is opened. The cables 94 are connected to the vehicle's battery wherein the negative cable is connected to the negative battery post and the positive cable is coupled to the positive battery post. The vehicle is then turned on. The apparatus 10 is activated by manipulating the on/off switch 86 into the on position. The air compressor 50 fills the bag 60 with air and lifts the vehicle off of a ground surface. The handle 66 is manipulated into the lowered position 68 to release air from the bag 60 and simultaneously lower the vehicle back onto the ground surface. In this manner, the apparatus 10 simplifies the task of changing a flat tire or rotating tires on the vehicle by using air power instead of requiring manual lifting.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An air-compressing automotive jack apparatus comprising:

a housing configured for positioning under a frame of a vehicle;

an air compressor coupled to said housing;

a bag coupled to said housing, said bag being operationally coupled to said air compressor wherein said air compressor is configured to supply air to said bag such that said bag is inflated when the air is received, said bag being configured to lift the vehicle when said bag is inflated and lower the vehicle when said bag is deflated;

an elongated handle extending outwardly from said housing, said handle being operationally coupled to said air compressor wherein said air compressor is configured to deflate said bag when said handle is in a lowered position and inflate said bag when said handle is in a raised position; and a pair of cables coupled to said air compressor wherein said cables are configured for coupling to a power supply in the vehicle;

an intake valve coupled to said air compressor wherein said intake valve is configured to receive air from said air compressor when said intake valve is opened;

a release valve coupled to said handle proximate a bottom end of said handle, said release valve being positioned in an interior space of said handle, said release valve being operationally coupled to said handle wherein said release valve is opened when said handle is in the lowered position and said release valve is closed when said handle is in the raised position; and an on/off switch coupled to said air compressor, said switch being electrically coupled to said intake valve wherein said intake valve is opened and configured to receive air when said switch is in an on position and closed when said switch is in an off position.

2. The apparatus of claim 1, further comprising:

said housing comprising a front end and a back end, said front end having an upper portion and a lower portion; and wherein said upper portion comprises a crest and a pair of slanted surfaces extending outwardly and downwardly from said crest.

3. The apparatus of claim 2, further comprising said air compressor being positioned on said front end above each of said slanted surfaces.

4. The apparatus of claim 2, further comprising a plurality of spaced wheels being coupled to said housing.

5. The apparatus of claim 2, further comprising a cavity extending downwardly into said housing, said cavity extending longitudinally across said back end of said housing.

6. The apparatus of claim 5, further comprising said cavity having a bottom surface and a perimeter edge extending upwardly away from said bottom surface, said perimeter edge being angled outwardly relative to said bottom surface.

7. The apparatus of claim 5, further comprising said cavity being offset from a pair of opposed long edges of said back end and a first lateral edge and a second lateral edge of said back end.

8. The apparatus of claim 5, further comprising said bag having a lower section and an upper section wherein said lower section lines said cavity in said housing and said upper section extends outwardly from said housing, said upper section being directed upwardly away from said housing when said bag is filled with air.

9. The apparatus of claim 1, further comprising said air compressor automatically turning off when said bag reaches a predetermined height.

10. The apparatus of claim 1, further comprising a shield coupled to said bag, said shield being positioned on a top side of said bag wherein said shield is configured to abut a surface under the vehicle and protect said bag from damage.

11. The apparatus of claim 1, further comprising a hose coupling said air compressor, said bag, and said handle.

12. The apparatus of claim 1, further comprising said cables being removably coupled to said air compressor.

13. The apparatus of claim 1, further comprising a pair of clips, each of said clips having a pair of grips and a pair of jaws wherein said grips are configured to open said jaws when said grips are urged together.

14. The apparatus of claim 13, further comprising said jaws being serrated.

15. The apparatus of claim 13, further comprising one of said grips of each of said clips being coupled to a second end of an associated one of said cables.

16. An air-compressing automotive jack apparatus comprising:

a housing configured for positioning under a frame of a vehicle, said housing comprising a front end and a back end, said front end having an upper portion and a lower portion, said upper portion comprising a crest and a pair of slanted surfaces extending outwardly and downwardly from said crest;

an air compressor coupled to said housing, said air compressor being positioned on said front end above each of said slanted surfaces, said air compressor being cylindrical;

a cavity extending downwardly into said housing, said cavity extending longitudinally across said back end of said housing, said cavity being offset from a pair of opposed long edges of said back end and said first and second lateral edges of said back end, said cavity having a bottom surface and a perimeter edge extending upwardly away from said bottom surface, said perimeter edge being angled outwardly relative to said bottom surface;

a bag coupled to said housing, said bag being operationally coupled to said air compressor wherein said air compressor is configured to supply air to said bag such that said bag is inflated when the air is received, said bag comprising a lower section and an upper section wherein said lower section lines said cavity in said housing and said upper section extends outwardly from said housing, said upper section being directed upwardly away from said housing when said bag is filled with air wherein said bag is configured to lift the vehicle when air is received therein and lower the vehicle when air is released therefrom, said air compressor automatically turning off when said bag reaches a predetermined height;

an elongated handle extending outwardly from said housing, said handle being operationally coupled to said air compressor wherein said air compressor is configured to deflate said bag when said handle is in a lowered position and inflate said bag when said handle is in a raised position;

a shield coupled to said bag, said shield being positioned on a top side of said bag wherein said shield is configured to abut a surface under the vehicle and protect said bag from damage;

an intake valve coupled to said air compressor wherein said intake valve is configured to receive air from said air compressor when said intake valve is opened, said intake valve being positioned on a back side of said air compressor;

a release valve coupled to said handle proximate a bottom end of said handle, said release valve being positioned in an interior space of said handle, said release valve being operationally coupled to said handle wherein said release valve is opened when said handle is in the lowered position and said release valve is closed when said handle is in the raised position;

an on/off switch coupled to said air compressor, said switch being positioned on an exterior face of a first end of said air compressor, said switch being electrically coupled to said intake valve wherein said intake valve is opened and configured to receive air when said switch is in an on position and said intake valve is closed when said switch is in an off position;

a hose coupling said air compressor, said bag, and said handle;

a pair of cables removably coupled to said air compressor wherein said cables are configured for coupling to a power supply of the vehicle wherein said power supply comprises a battery; and a pair of clips, each of said clips having a pair of grips and a pair of jaws wherein said grips are configured to open said jaws when said grips are urged together, said jaws being serrated, one of said grips of each of said clips being coupled to a second end of an associated one of said cables.

* * * * *